US007694423B2

(12) United States Patent
Hasegawa

(10) Patent No.: US 7,694,423 B2
(45) Date of Patent: Apr. 13, 2010

(54) FINGERHOOK STRUCTURE OF SCISSORS

(75) Inventor: Katsumi Hasegawa, Seki (JP)

(73) Assignee: Kai R&D Center Co., Ltd., Gifu-ken (JP)

( * ) Notice: Subject to any disclaimer, the term of this patent is extended or adjusted under 35 U.S.C. 154(b) by 233 days.

(21) Appl. No.: 11/632,633

(22) PCT Filed: Dec. 14, 2005

(86) PCT No.: PCT/JP2005/022954

§ 371 (c)(1),
(2), (4) Date: Jan. 16, 2007

(87) PCT Pub. No.: WO2006/064843

PCT Pub. Date: Jun. 22, 2006

(65) Prior Publication Data

US 2008/0028621 A1 Feb. 7, 2008

(30) Foreign Application Priority Data

Dec. 16, 2004 (JP) ..... 2004-364576

(51) Int. Cl.
*B26B 13/20* (2006.01)

(52) U.S. Cl. ..... 30/232; 30/341

(58) Field of Classification Search ..... 30/341, 30/232, 244

See application file for complete search history.

(56) References Cited

U.S. PATENT DOCUMENTS

| | | | | |
|---|---|---|---|---|
| 2,006,926 | A * | 7/1935 | Lincoln | 30/341 |
| 4,825,552 | A * | 5/1989 | Bendickson et al. | 30/342 |
| D423,317 | S * | 4/2000 | Takeshita | D8/98 |
| RE37,190 | E * | 5/2001 | Stowell et al. | 16/422 |
| 6,493,947 | B2 * | 12/2002 | Stokes | 30/341 |
| 2002/0170181 | A1 * | 11/2002 | Schallenberg | 30/232 |
| 2005/0283980 | A1 * | 12/2005 | Bathard et al. | 30/131 |
| 2006/0123634 | A1 * | 6/2006 | Peterson et al. | 30/232 |

FOREIGN PATENT DOCUMENTS

| | | |
|---|---|---|
| EP | 1 829 653 A1 * | 9/2007 |
| JP | A-2-59772 | 5/1990 |
| JP | A-4-77869 | 7/1992 |
| JP | A-2002-119776 | 4/2002 |
| JP | A-2003-135474 | 5/2003 |
| JP | A-2004-129845 | 4/2004 |

OTHER PUBLICATIONS

Search Report from Patent Cooperation Treaty issued on Mar. 14, 2006 for the corresponding PCT patent application No. PCT/JP2005/022954.

* cited by examiner

*Primary Examiner*—Hwei-Siu C Payer
(74) *Attorney, Agent, or Firm*—Posz Law Group, PLC

(57) ABSTRACT

A pair of western scissors include opposing scissor pieces that are supported by a pivotal center portion to allow the scissor pieces to open and close with respect to each other. A fingerhook ring is provided in each of opposing handle portions provided in the corresponding scissor pieces. The fingerhook ring has a plurality of elastic projections that are parallel and extend outward. Grooves are defined between each adjacent pair of the elastic projections as deformation allowing spaces. A finger receiving portion is formed by the outer ends of the elastic projections and the openings of the grooves exposed between each adjacent pair of the outer ends. The elastic projections are deformable by the force applied by a finger to the finger receiving portion.

5 Claims, 11 Drawing Sheets

FINGERHOOK STRUCTURE OF SCISSORS

FIELD OF THE INVENTION

The present invention relates to a fingerhook structure provided in the handles of a pair of scissors such as western scissors or grip type scissors.

BACKGROUND OF THE INVENTION

In a pair of handles provided in a western scissors of Patent Document 1, inner holder rings secured to blade bodies are covered by outer holder rings, which are softer than the inner holder rings. A pair of holding portions provided in a gripping shank of grip type scissors of Patent Document 2 are formed by a hard inner resin portion secured to blade bodies and a soft outer resin portion having a holding surface on which anti-slip asperities are formed. Thus, fingers contact the soft outer holding rings when the western scissors are in use and the soft outer resin portion when the grip type scissors are in use. This provides soft feel when using these scissors, facilitating use of the scissors.

Patent Document 1: Japanese Laid-Open Utility Model Publication No. 4-77869

Patent Document 2: Japanese Laid-Open Patent Publication No. 2004-129845

SUMMARY OF THE INVENTION

However, although the outer holding rings or the outer resin portion, with which fingers are held in contact when the scissors are in use, are formed by soft material, the degree of elasticity of the outer holding rings and the outer resin portion varies in correspondence with the type of the resin portion varies in correspondence with the type of the soft material or the thickness of the material. Further, if the scissors are designed under restricted design conditions, it is impossible to achieve an appropriate degree of elasticity. In this case, feel of the scissors in use cannot be sufficiently improved.

It is an objective of the present invention to further improve feel of scissors in use and facilitate such use of the scissors.

A first aspect of the present invention provides a fingerhook structure of a pair of scissors in which a pair of scissor pieces are supported by a pivotal center portion in such a manner as to allow the scissor pieces to open and close with respect to each other, the fingerhook structure being characterized in that a fingerhook portion is formed in at least one of handle portions each provided in the corresponding one of the scissor pieces, the fingerhook portion having a finger receiving portion, the finger receiving portion being deformable by the force applied to the finger receiving portion.

This configuration facilitates deformation of the finger receiving portion and provides an appropriate level of elasticity of the finger receiving portion regardless of limitations to the design conditions such as the type of the material and the thickness of the finger receiving portion.

A second aspect of the present invention provides a fingerhook structure of a pair of scissors in which a pair of scissor pieces are supported by a pivotal center portion in such a manner as to allow the scissor pieces to open and close with respect to each other, the fingerhook structure being characterized in that a fingerhook portion is formed in at least one of handle portions each provided in the corresponding one of the scissor pieces, the fingerhook portion including a plurality of elastic projections that are arranged in parallel and extend from inward to outward, a finger receiving portion being formed by outer ends of the elastic projections, each elastic projection being deformable by the force applied to the finger receiving portion.

This configuration allows the elastic projections to facilitate deformation of the finger receiving portion formed by the outer ends of the elastic projections. Therefore, an appropriate level of elasticity of the finger receiving portion is ensured regardless of limitations to the design conditions such as the type of the material and the thickness of the finger receiving portion.

It is preferred that a deformation allowing space is provided in the finger receiving portion and between an each adjacent pair of the elastic projections and the finger receiving portion is configured by the outer ends of the elastic projections and the openings of the deformation allowing spaces exposed between each adjacent pair of the outer ends.

In this structure, the deformation allowing spaces facilitate deformation of the elastic projections. Alternatively, the elastic projections may be arranged in contact with adjacent ones and a simple notch may be defined between each adjacent pair of the elastic projections. Such notches correspond to the deformation allowing spaces.

In the fingerhook portion, it is preferred that the deformation allowing spaces be grooves each defined between the corresponding adjacent pair of the elastic projections. Each of the grooves may be open or closed at opposing sides in a direction extending along each elastic projection. If the opposing sides of each groove are closed, the groove is a recess that opens only at the opening. This structure facilitates deformation of the finger receiving portion formed by the outer ends of the elastic projections in a direction in which the elastic projections are arranged in parallel.

It is preferred that, if the finger receiving portion is divided into opposing side areas including an outer circumferential portion of the finger receiving portion and an intermediate area between the side areas, deformation caused by the force in the finger receiving portion become greater in the intermediate area than the side areas. In this case, a finger is maintained stable when received by the finger receiving portion.

It is preferred that the finger receiving portion have a finger receiving surface recessed inward with respect to an imaginary plane including opposing side portions of the outer circumferential portion of the finger receiving portion. In this case, a finger is maintained stable when received by the finger receiving portion.

If the scissors are a pair of western scissors including opposing scissor pieces that cross each other at a pivotal center portion, a blade portion provided in each of the scissor pieces at a position proximal from the pivotal center portion, and a handle portion arranged in each scissor piece at a position distal from the pivotal center portion, it is preferred that a fingerhook ring provided in each of the handle portions of the western scissors have an inner circumferential surface, an outer circumferential surface, and opposing side surfaces between the inner circumferential surface and the outer circumferential surface, and that the finger receiving portion be formed in at least any one of the inner circumferential surface, the outer circumferential surface, and the side surfaces of at least one of the fingerhook rings.

If the scissors are a pair of grip type scissors including opposing scissor pieces that support each other at a pivotal center portion located at a proximal position of the scissor pieces, a blade portion provided at a distal position of each of the scissor pieces, and a handle portion that are arranged in each of the scissor pieces and extend between the corresponding blade portion and the pivotal center portion, it is preferred that the finger receiving portion is arranged in at least one of the handle portions of the grip type scissors.

DETAILED DESCRIPTION OF THE PREFERRED EMBODIMENTS

Figure 1:
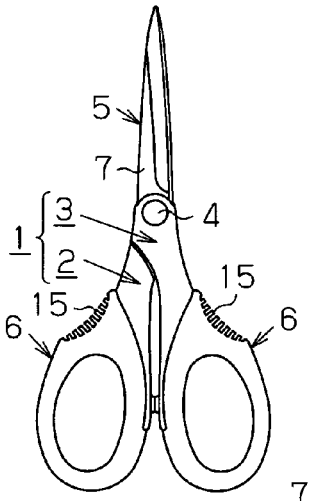
FIG. 1 (a) is a front view showing a pair of western scissors, as a whole, according to a first embodiment of the present invention; (b) is a back view showing the western scissors as a whole; (c) is an enlarged partial front view of the western scissors, showing the handle portions.
Figure 1:
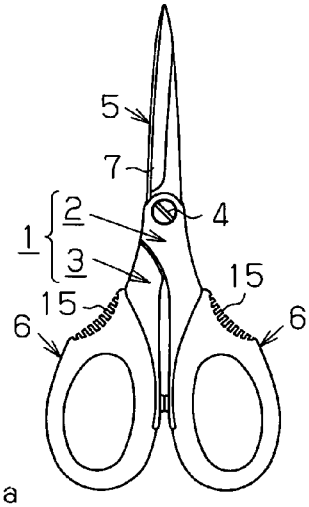
Figure 1:
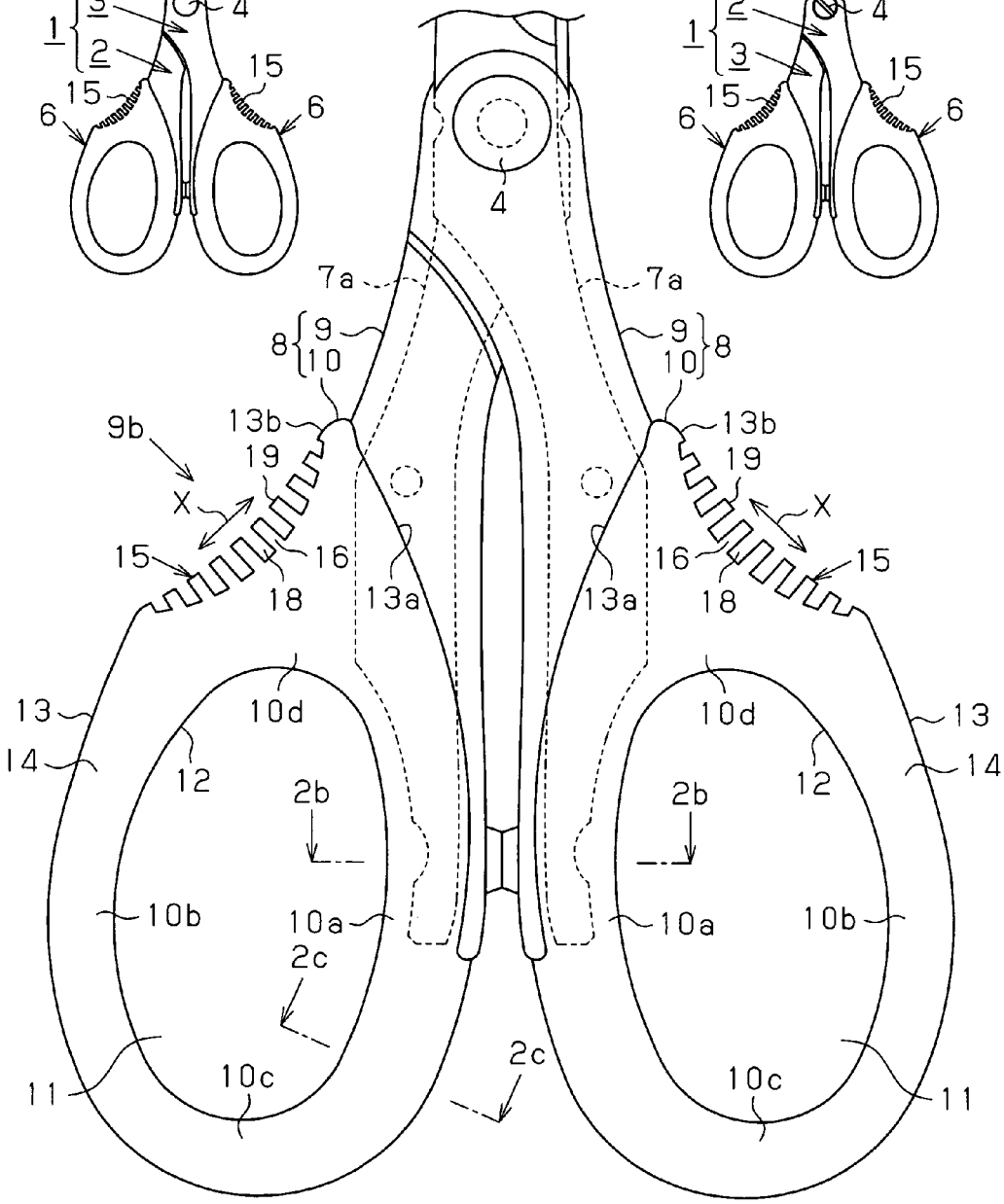
Figure 2B:
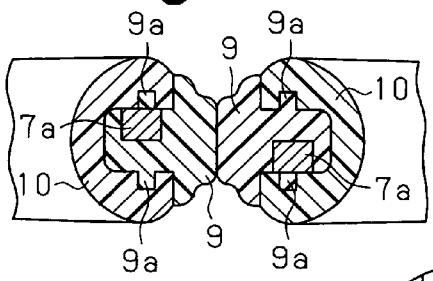
FIG. 2 (a) is an enlarged partial front view of the western scissors, showing the handle portions in a cutaway state; (b) is a cross-sectional view taken along line 2*b*-2*b* of FIG. 1(*c*); (c) is a cross-sectional view taken along line 2*c*-2*c* of FIG. 1(*c*)
Figure 2C:
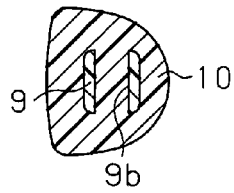
Figure 2A:
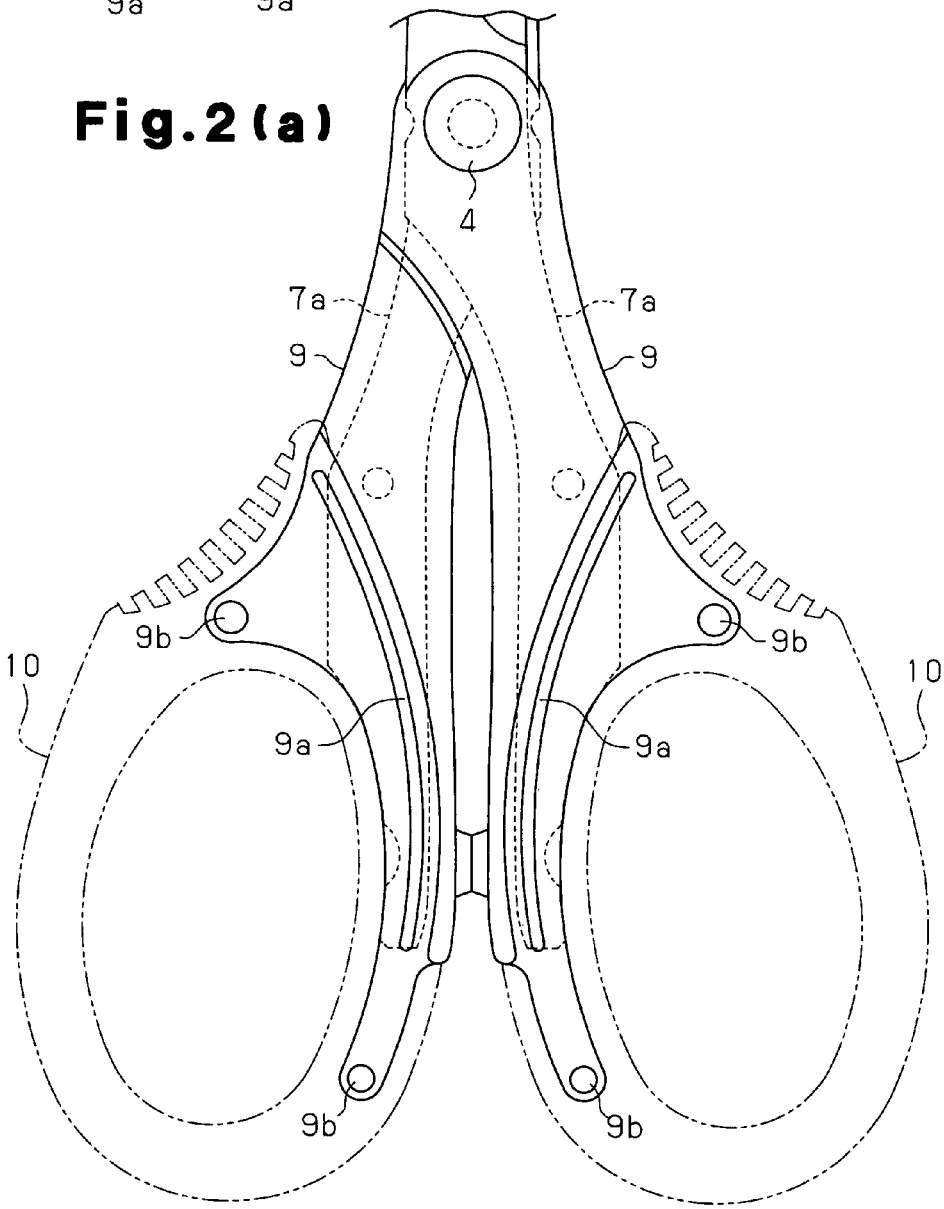

First, a fingerhook structure of a pair of scissors according to a first embodiment of the present invention will be described with reference to FIGS. 1, 2, and 9.

In a pair of western scissors 1, a pair of scissor pieces 2, 3 are connected together at a pivotal center portion 4 in such a manner as to allow the scissor pieces 2, 3 to pivot with respect to the pivotal center portion 4. A blade portion 5 is provided in each of the scissor pieces 2, 3 at a distal position with respect to the pivotal center portion 4. A handle portion 6 is formed in each scissor piece 2, 3 at a proximal position with respect to the pivotal center portion 4. The blade portion 5 of each scissor piece 2, 3 is formed by a metal blade body 7. The handle portion 6 of each scissor piece 2, 3 has a holding portion 8 formed of synthetic resin. Each of the holding portions 8 includes a support portion 9 and a fingerhook ring 10 (a fingerhook portion). Each of the support portion 9 is secured to a connection plate 7*a* extending from the corresponding one of the blade bodies 7. Each of the fingerhook rings 10 is secured to the associated one of the support portions 9. The support portion 9 of each holding portion 8 includes the pivotal center portion 4 and covers the entire outer circumference of the associated connection plate 7*a*.

To secure each support portion 9 to the associated connection plate 7*a* as an integral body, the connection plate 7*a* of the blade body 7 is inserted in a cavity of a mold (not shown) and synthetic resin (for example, plastic such as PP (polypropylene) or ABS (acrylonitrile-butadiene-styrene)) is injected into the cavity. Further, to secure the fingerhook ring 10 to the support portion 9 as an integral body, the support portion 9 is inserted in a cavity of a mold (not shown) and synthetic resin softer than the support portion 9 (for example, elastomer such as synthetic rubber) is injected into the cavity. A projection 9*a* and a through hole 9*b* are then provided in the support portion 9 of each of the fingerhook rings 10. The projection 9*a* sinks into the fingerhook ring 10 and the fingerhook ring 10 enters the through hole 9*b*. In this manner, the projection 9*a* and the through hole 9*b* function as a stopper of the fingerhook ring 10 with respect to the support portion 9.

The fingerhook ring 10 of each holding portion 8 has an inner frame portion 10*a*, an outer frame portion 10*b*, a lower frame portion 10*c*, and an upper frame portion 10*d*. The inner frame portions 10*a* of the fingerhook rings 10 oppose each other. The outer frame portion 10*b* of each fingerhook ring 10 opposes the associated inner frame portion 10*a* through a fingerhook bore 11. The lower frame portion 10*c* of each fingerhook ring 10 is arranged between the lower side of the inner frame portion 10*a* and the lower side of the outer frame portion 10*b*. The upper frame portion 10*d* of each fingerhook ring 10 opposes the associated lower frame portion 10*c* through the corresponding fingerhook bore 11. Further, each fingerhook ring 10 has an annular inner circumferential surface 12, an annular outer circumferential surface 13, and an annular side surface 14. The inner circumferential surface 12 outlines the associated fingerhook bore 11. The outer circumferential surface 13 is provided outwardly from the inner circumferential surface 12. The side surface 14 extends between the inner circumferential surface 12 and the outer circumferential surface 13. The outer circumferential surface 13 in the upper frame portion 10*d* of each fingerhook ring 10 is formed in a inverted-V shape by an outer circumferential surface 13*a* extending continuously from the outer circumferential surface 13 of the inner frame portion 10*a* and an outer circumferential surface 13*b* extending continuously from the outer circumferential surface 13 of the outer frame portion 10*b*. A soft portion 15 is formed in the outer circumferential surface 13*b*.

A plurality of elastic projections 16 project outward from an inner bottom 17 of each of the soft portions 15. The projections 16 of each soft portion 15 are arranged in parallel in an arranging direction X of the fingerhook ring 10. Each of the projections 16 extends in a width direction Y perpendicular to the arranging direction X, or direction Y extending between the opposing side surfaces 14. Grooves 18 (deformation allowing spaces) are each provided between the corresponding adjacent pair of the elastic projections 16. Each of the grooves 18 has an opening 18*a*, which is defined between outer ends 16*a* of the corresponding adjacent pair of the elastic projections 16, and openings provided at both sides in the width direction Y. The group of the outer ends 16*a* of the elastic projections 16 define a finger receiving portion 19. Each of the finger receiving portions 19 includes the openings 18*a*. As illustrated in FIG. 9(*d*) or 9(*e*), the outer end 16*a* of each elastic projection 16 is curved in a manner projecting outward in such a manner that the height of the elastic projection 16 becomes maximum at the center of the projection 16 in the width direction Y. Each finger receiving portion 19 has a finger receiving surface 21 recessed in a U-shaped manner inwardly with respect to an imaginary plane P that includes opposing side portions 20*a* of an outer circumferential portion 20 of the finger receiving portion 19 in the arranging direction X of the elastic projections 16. The finger receiving surface 21 are connected smoothly to the outer circumferential surface 13*b* and the side surfaces 14 at the outer circumferential portion 20.

The plane defined by connecting proximal ends 16*b* of the elastic projections 16 and bottoms 18*b* of the grooves 18 together along the arranging direction X is also recessed in a U-shaped manner like the finger receiving surface 21. The bottoms 18*b* of the grooves 18 may be formed flat as in the case of FIG. 9(*d*) or curved in a manner projecting outward in correspondence with the outer ends 16*a* of the elastic projections 16 as in the case of FIG. 9(*e*).

Each finger receiving portion 19 may be divided into side areas M each including the outer circumferential portion 20 and an intermediate area N arranged between the side areas M. In this case, as illustrated in FIG. 9(*a*), the height H of each elastic projection 16 from the bottom 17 to the outer end 16*a*, the depth L of the finger receiving surface 21 with respect to the imaginary plane P, and the width W of the finger receiving surface 21 in direction Y are greater in the intermediate area N than the side areas M. The height H and the depth L become gradually greater from the side portions 20*a* of the outer circumferential portion 20 toward the intermediate portion between the side portions 20*a*. The elastic projections 16 have equal thicknesses T in the arranging direction X. The grooves 18, each of which is provided between the corresponding adjacent pair of the elastic projections 16, have equal clearances S in the arranging direction X. The clearance S is substantially equal to the thickness T of each elastic projection 16.

Alternatively, the clearance S and the thickness T may differ from each other. For example, the thickness T may be decreased toward the middle portion in the arranging direction X. The height H, the thickness T, and the width W of each elastic projection 16 may be set to satisfy the following formulas: 0.5 mm≦H≦10 mm; 0.2 mm≦T≦5 mm; and 1 mm≦H≦20 mm. The bottom 17 of the soft portion 15 of the fingerhook ring 10 of each holding portion 8 is spaced from the support portion 9.

To use the western scissors 1, the middle finger, the ring finger, and the little finger are inserted into the fingerhook bore 11 of one of the fingerhook rings 10. The thumb is then inserted into the fingerhook bore 11 of the other fingerhook ring 10 and the forefinger is held in contact with the finger receiving surface 21 of the finger receiving portion 19 of the corresponding one of the fingerhook rings 10. In this state, if the western scissors 1 are opened or closed, force is produced also by the forefinger. The force, which is produced by the forefinger, thus acts to deform the elastic projections 16 in a range allowed by the grooves 18 mainly in the arranging direction X. The extent and the direction of the deformation δ caused in the finger receiving portion 19 are varied among the outer ends 16*a* of the elastic projections 16, in correspondence with the extent and the direction of the force produced by the forefinger. The deformation δ may become greater in the intermediate area N than the side areas M.

Figure 3A:
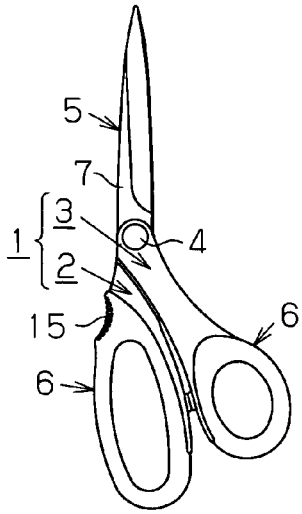
FIG. 3 (a) is a front view showing a pair of western scissors, as a whole, according to a second embodiment of the present invention; (b) is a back view showing the western scissors as a whole; (c) is an enlarged partial front view of the western scissors, showing the handle portions.
Figure 3B:
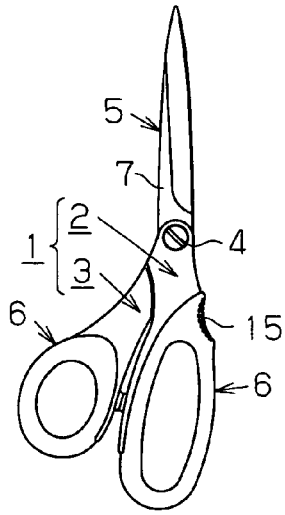
Figure 3C:
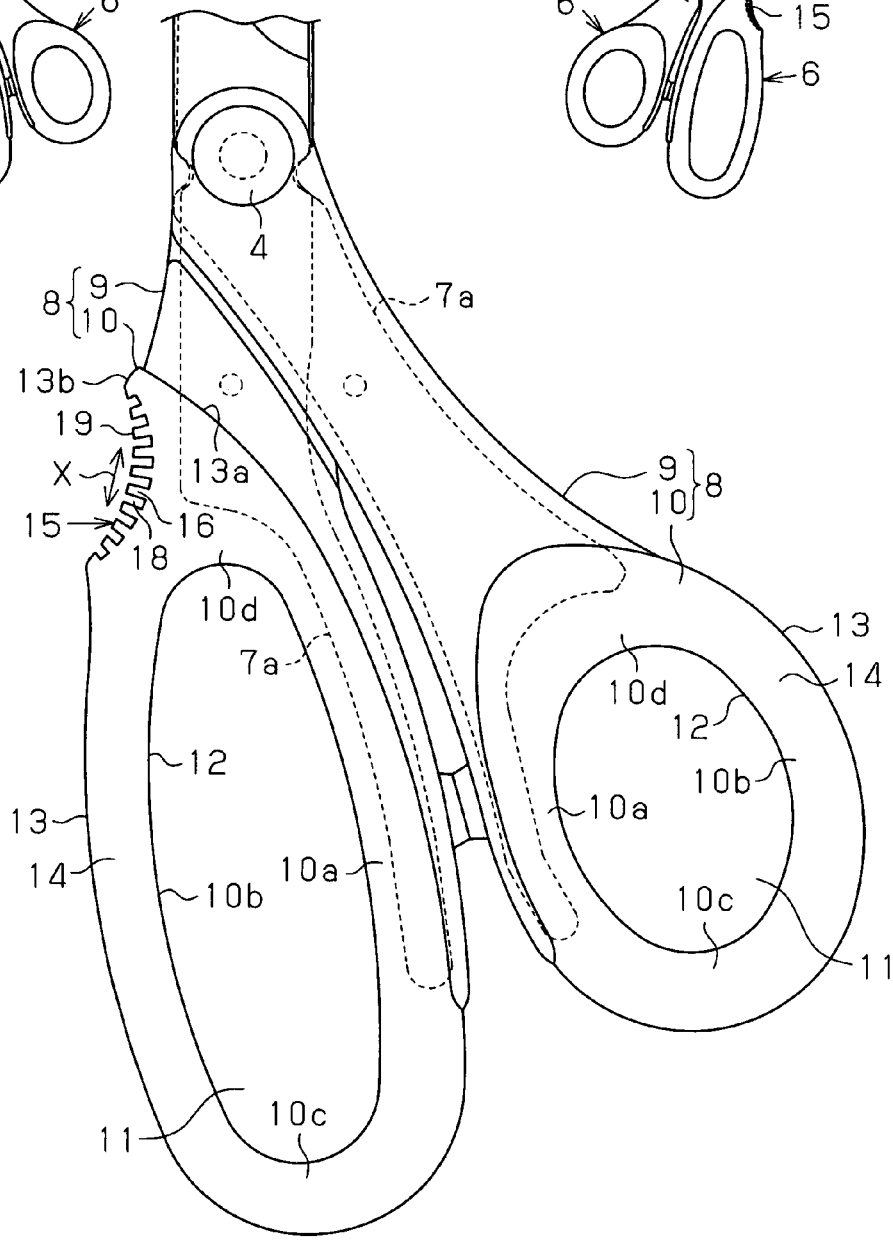

In the first embodiment, the thumb or the other fingers may be inserted in any one of the fingerhook rings 10. However, in a second embodiment, as shown in FIGS. 3(*a*) to 3(*c*), fingers other than the thumb are inserted in a fingerhook ring 10 of a scissor piece 2 and the thumb is inserted in a fingerhook ring 10 of a scissor piece 3. A soft portion 15 like that of the first embodiment is formed only in the fingerhook ring 10 in which fingers other than the thumb are inserted.

Figure 4:
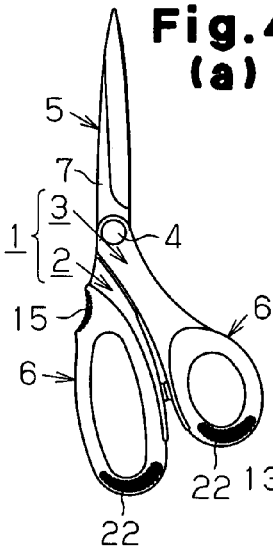
FIG. 4 (a) is a front view showing a pair of western scissors, as a whole, according to a third embodiment of the present invention; (b) is a back view showing the western scissors as a whole; (c) is an enlarged partial front view of the western scissors, showing the handle portions; (d) is an enlarged partial bottom view of the western scissors, showing the handle portions.
Figure 4:
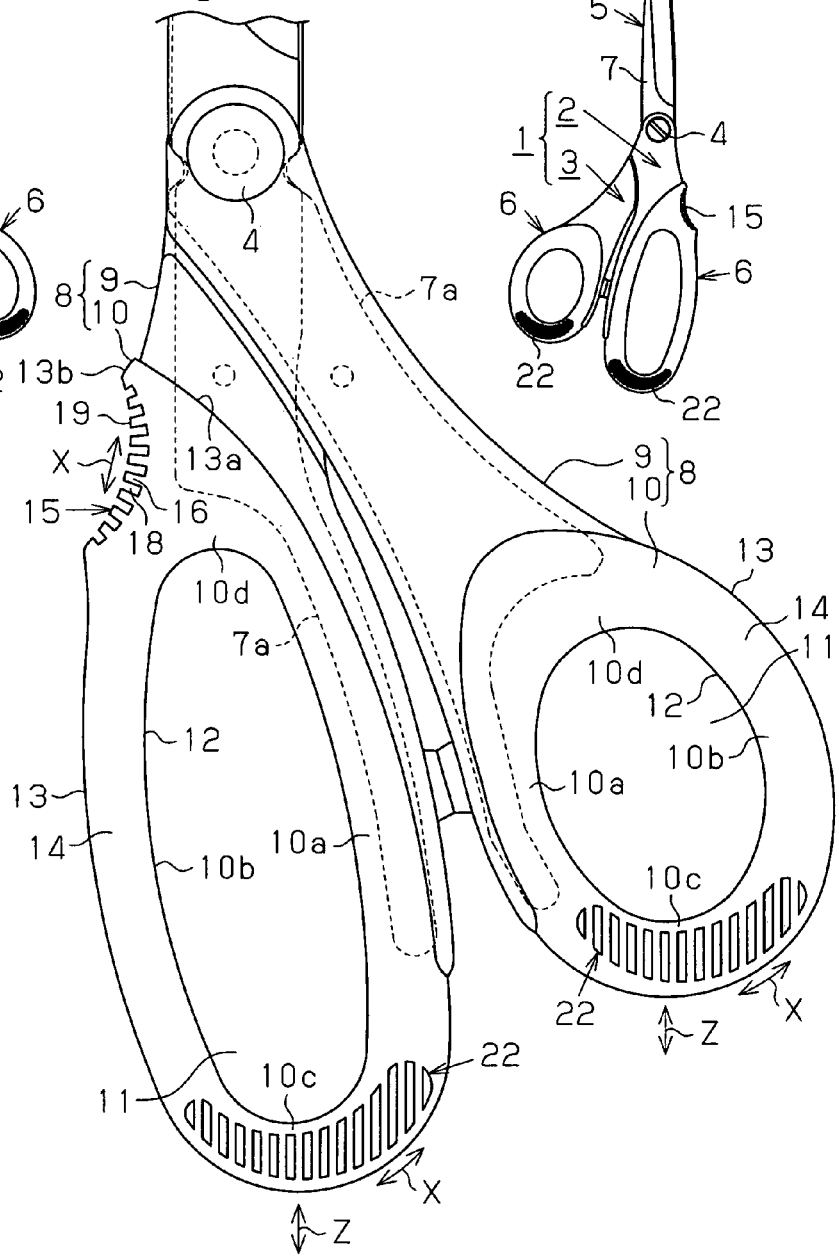
Figure 4:
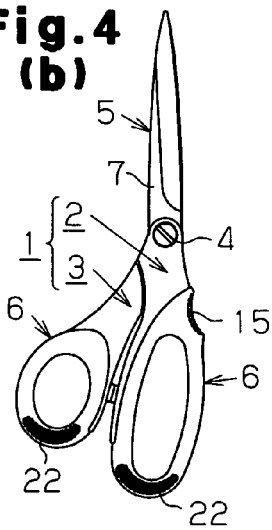
Figure 4:
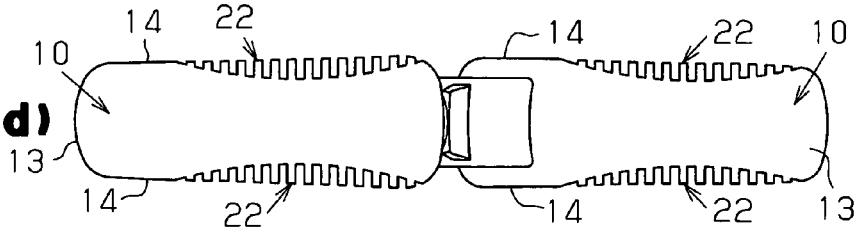

In a third embodiment, as illustrated in FIGS. 4(*a*) to 4(*c*) and 10(*a*), 10(*b*), and 10(*c*), a soft portion 22 is provided in each of side surfaces 14 of a lower frame portion 10*c* of each fingerhook ring 10 of the second embodiment. The shape of each of the soft portions 22 is basically identical with the shape of the soft portion 15 of the first embodiment but different from the soft portion 15 of the first embodiment in that a finger receiving surface 21 of the soft portion 22 is not recessed. Further, unlike the soft portion 15 of the first embodiment, elastic projections 16 each extend in the thickness direction Z extending between an inner circumferential surface 12 and an outer circumferential surface 13 of the corresponding fingerhook ring 10. Also, an opening 18*a* of each groove 18 has openings at opposing sides in the thickness direction Z. Further, each elastic projection 16 has a shape projecting outward in such a manner that the height of an outer end 16*a* of the elastic projection 16 becomes highest at the middle of the thickness direction Z. In a modification of the third embodiment, as illustrated in FIGS. 10(*d*) and 10(*e*), each soft portion 22 has a plurality of elastic projections 16 arranged in parallel in the thickness direction Z of a corresponding fingerhook ring 10. Each of the elastic projections 16 projects in an arcuate shape along the arranging direction X of the fingerhook ring 10 and grooves 18 are defined between each adjacent pair of the elastic projections 16.

Figure 5A:
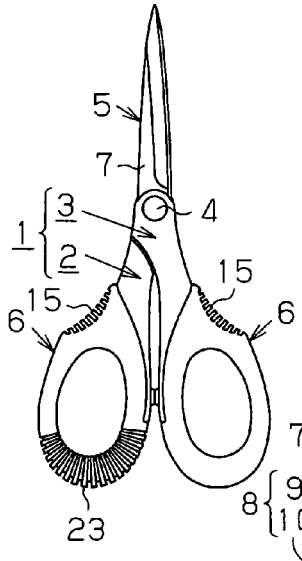
FIG. 5 (a) is a front view showing a pair of western scissors, as a whole, according to a fourth embodiment of the present invention; (b) is a back view showing the western scissors as a whole; (c) is an enlarged partial front view of the western scissors, showing the handle portions.
Figure 5B:
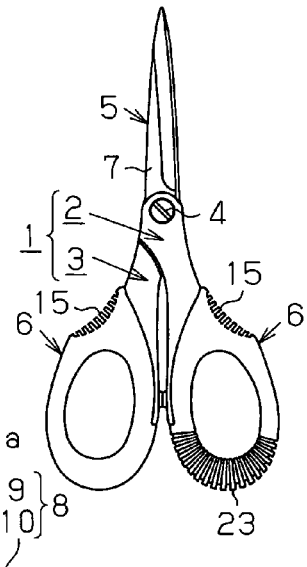
Figure 5C:
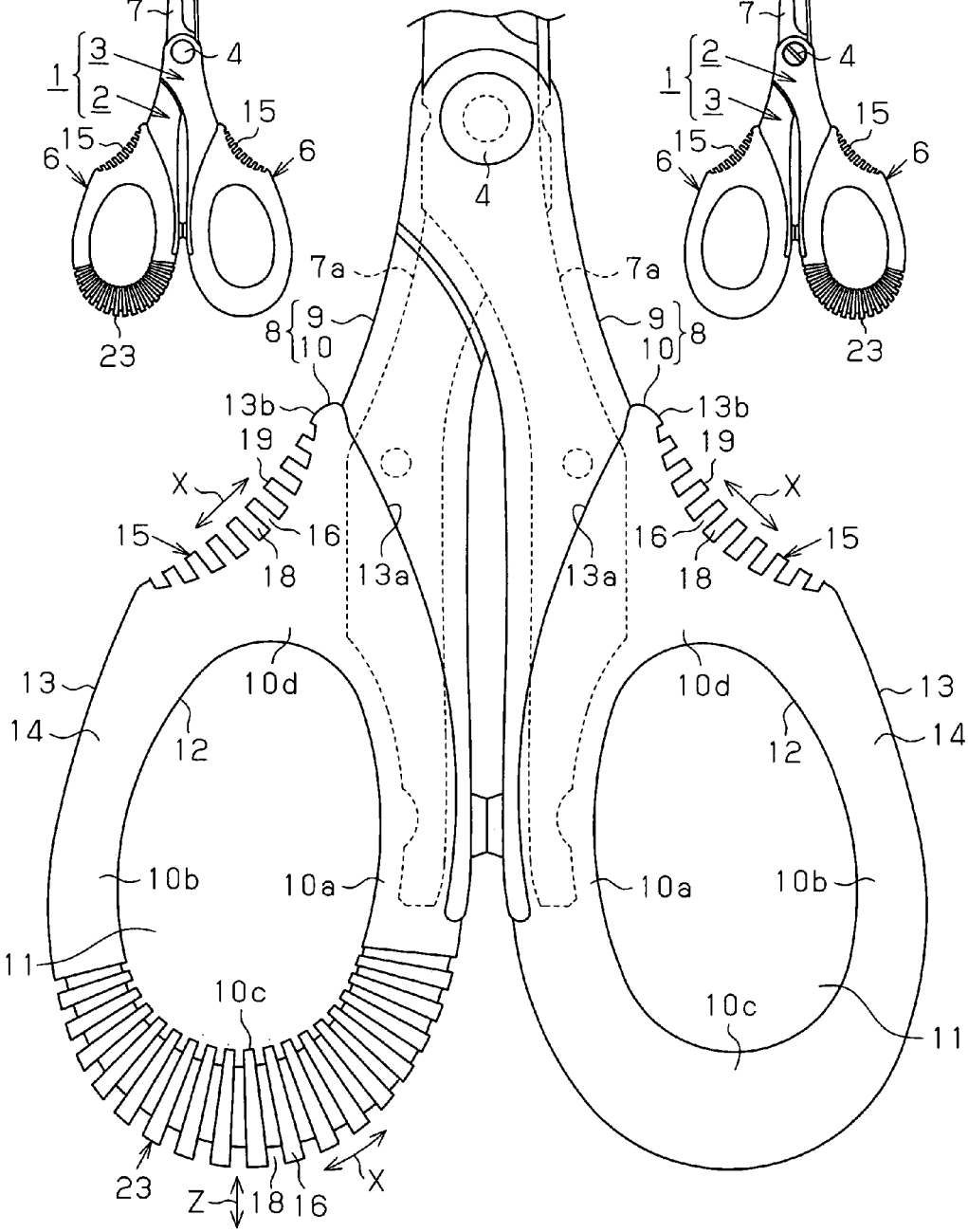

In a fourth embodiment, as illustrated in FIGS. 5(*a*) to 5(*c*), a soft portion 23 is provided along the entire circumferential direction including an inner circumferential surface 12, an outer circumferential surface 13, and opposing side surfaces 14 of a lower frame portion 10*c* of a fingerhook ring 10 of a scissor piece 2 of the first embodiment. In the soft portion 23, elastic projections 16 and grooves 18 defined between each adjacent pair of the elastic projections 16 are arranged annularly along the entire circumferential direction. The elastic projections 16 and the grooves 18 are arranged alternately in the arranging direction X of the fingerhook ring 10.

Figure 6A:
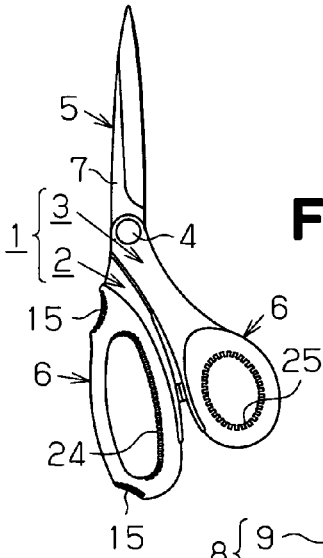
FIG. 6 (a) is a front view showing a pair of western scissors, as a whole, according to a fifth embodiment of the present invention; (b) is a back view showing the western scissors as a whole; (c) is an enlarged partial front view of the western scissors, showing the handle portions.
Figure 6B:
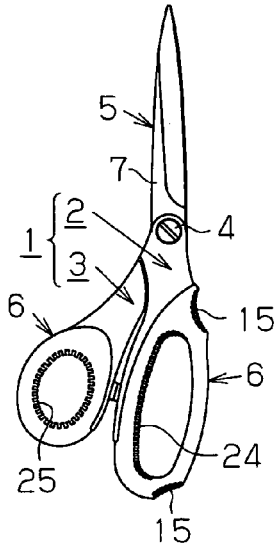
Figure 6C:
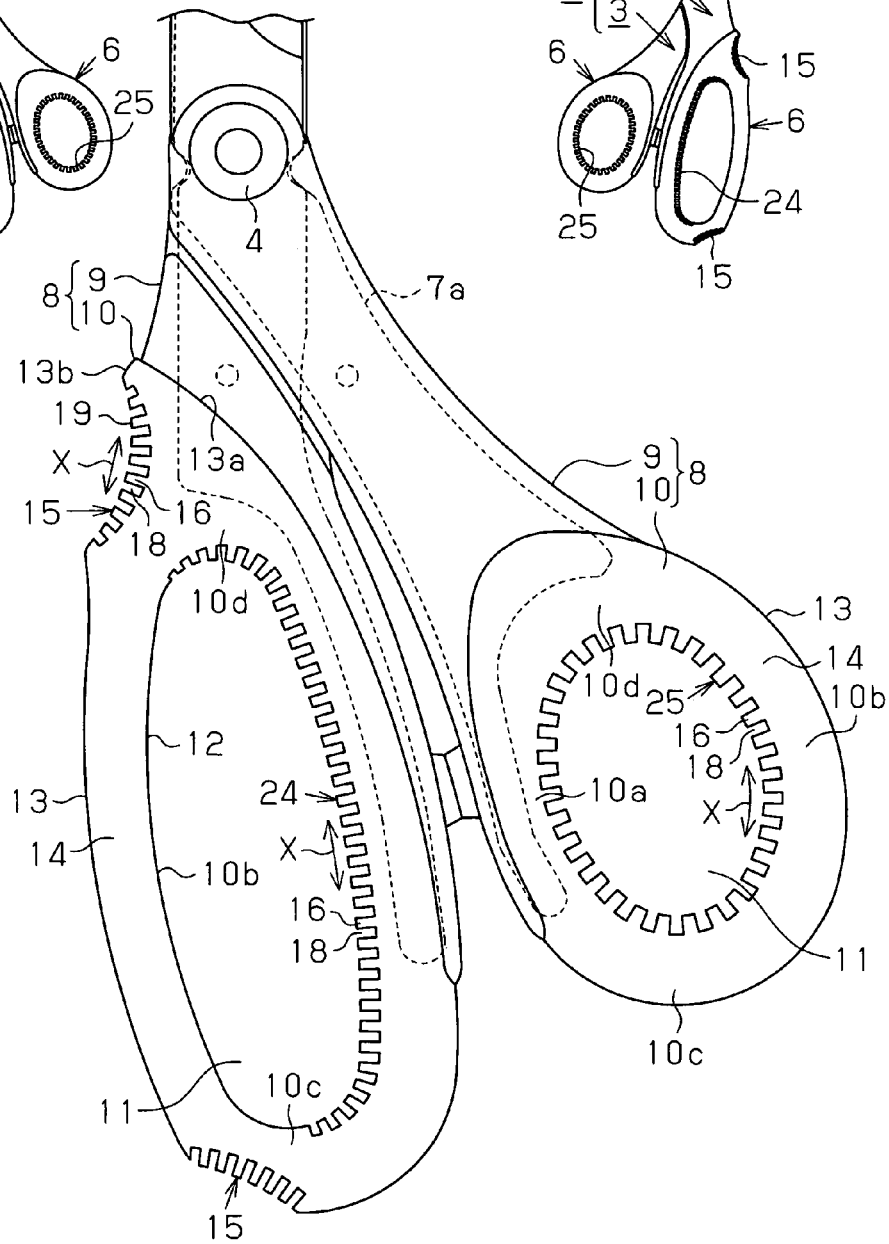

In a fifth embodiment, as illustrated in FIGS. 6(*a*) to 6(*c*), a soft portion 24 is formed in a portion of an inner circumferential surface 12 (for example, the inner circumferential surface 12 extending from an inner frame portion 10*a* to a lower frame portion 10*c* and an upper frame portion 10*d*) of a fingerhook bore 11 of a fingerhook ring 10 provided in a scissor piece 2 through which fingers other than the thumb are passed. A soft portion 15 similar to that of the first embodiment is formed in an outer circumferential surface 13 of a lower frame portion 10*c*. A soft portion 25 is provided in the entire inner circumferential surface 12 of the fingerhook bore 11 of the fingerhook ring 10 of a scissor piece 3, through which the thumb is passed. In each of the soft portions 24, 25, the elastic projections 16 and the grooves 18 defined between each adjacent pair of the elastic projections 16 are arranged alternately in the arranging direction X of the associated fingerhook ring 10.

Figure 7B:
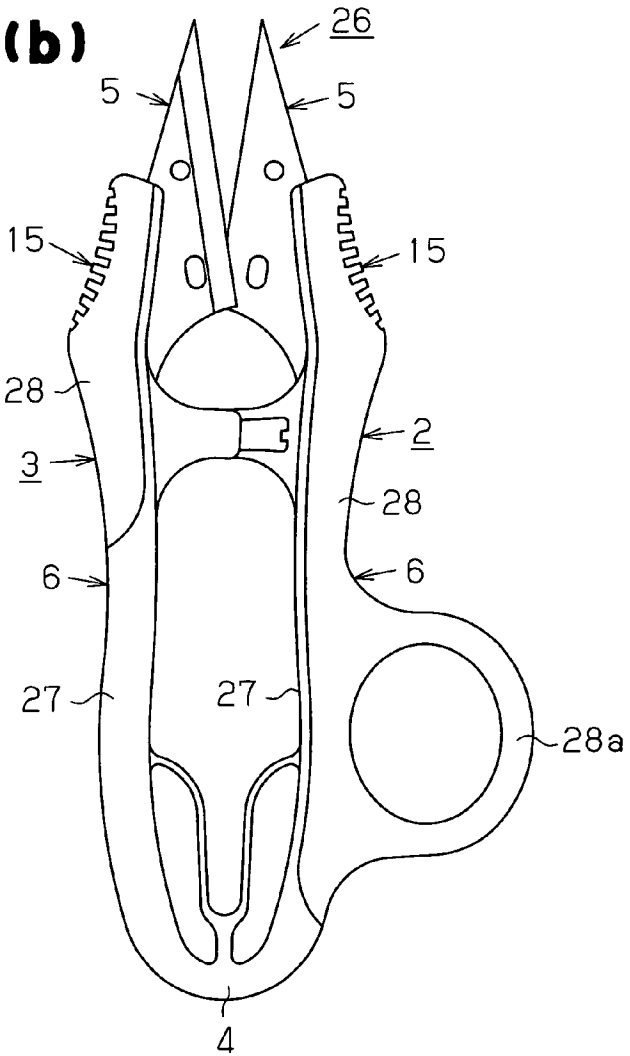
FIG. 7 (a) is a front view showing a pair of grip type scissors, as a whole, according to a sixth embodiment of the present invention; (b) is a back view showing the grip type scissors as a whole.
Figure 7A:
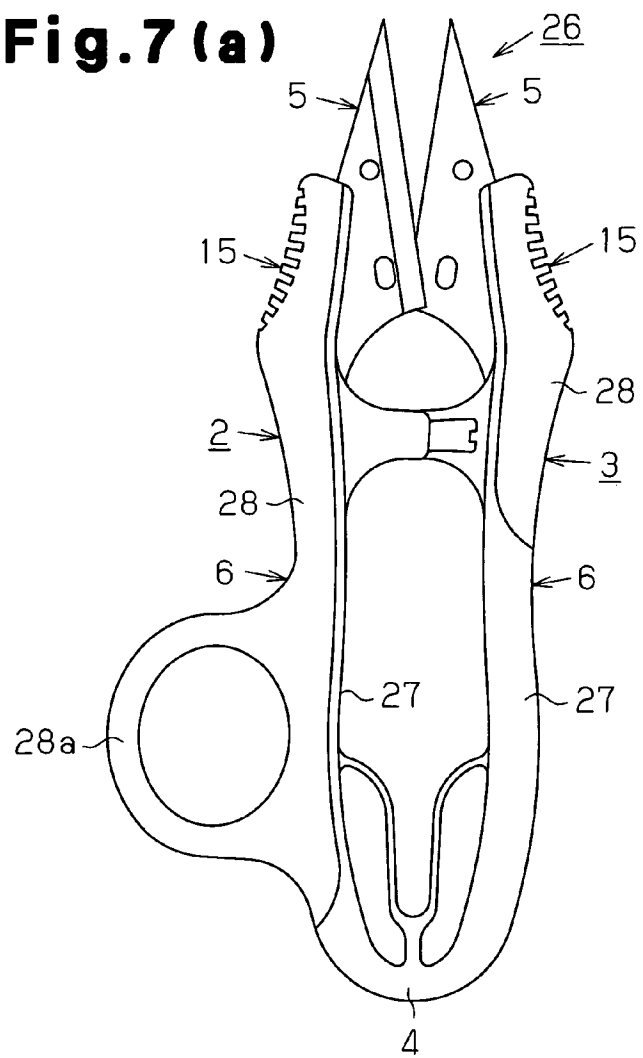

In a pair of grip type scissors 26 of a sixth embodiment, as illustrated in FIGS. 7(*a*) and 7(*b*), scissor pieces 2, 3 are connected as an integral body at a pivotal center portion 4, which is provided at the proximal position in the scissor pieces 2, 3. A blade portion 5 is arranged at a distal position in each of the scissor pieces 2, 3. Each scissor piece 2, 3 has a handle portion 6 provided between the corresponding blade portion 5 and the pivotal center portion 4. Each of the handle portions 6 is formed by a support portion 27 (a hard resin portion) and a fingerhook portion 28 (a soft resin portion), which is secured to the support portion 27 as an integral body through insert molding. The opposing support portions 27 are shaped in a U-shaped manner with respect to the pivotal center portion 4. The support portions 27 are secured to the corresponding blade portions 5 as an integral body through insert molding. A soft portion 15 similar to that of the first embodiment is formed in a distal portion of each fingerhook portion 28 and in the vicinity of the associated blade portion 5. An annular portion 28*a* is provided in a proximal portion of the fingerhook portion 28 of the scissor piece 2.

Figure 8B:
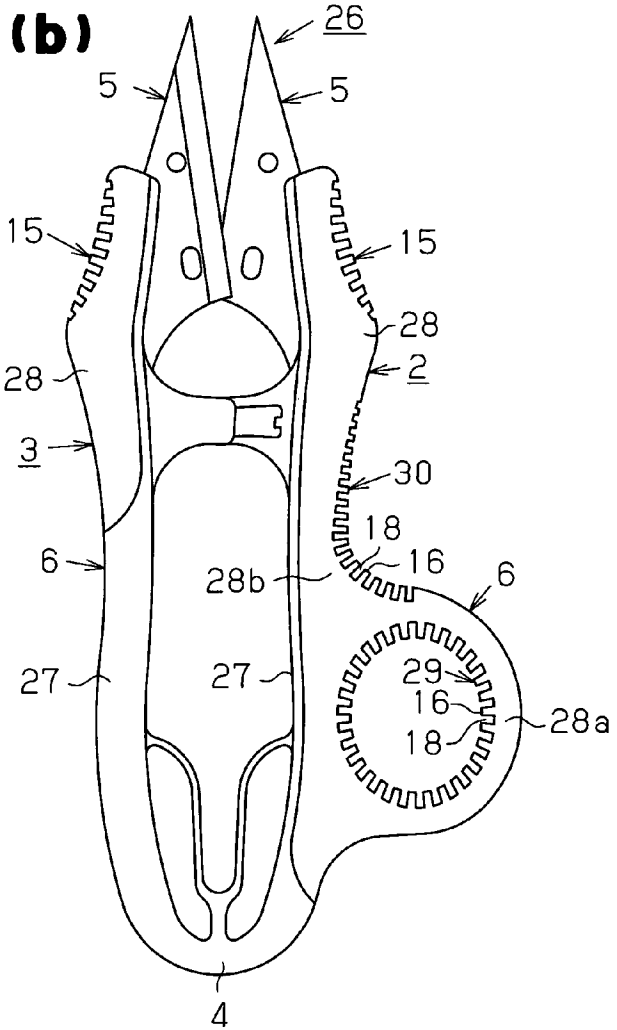
FIG. 8 (a) is a front view showing a pair of grip type scissors, as a whole, according to a seventh embodiment of the present invention; (b) is a back view showing the grip type scissors as a whole.
Figure 8A:
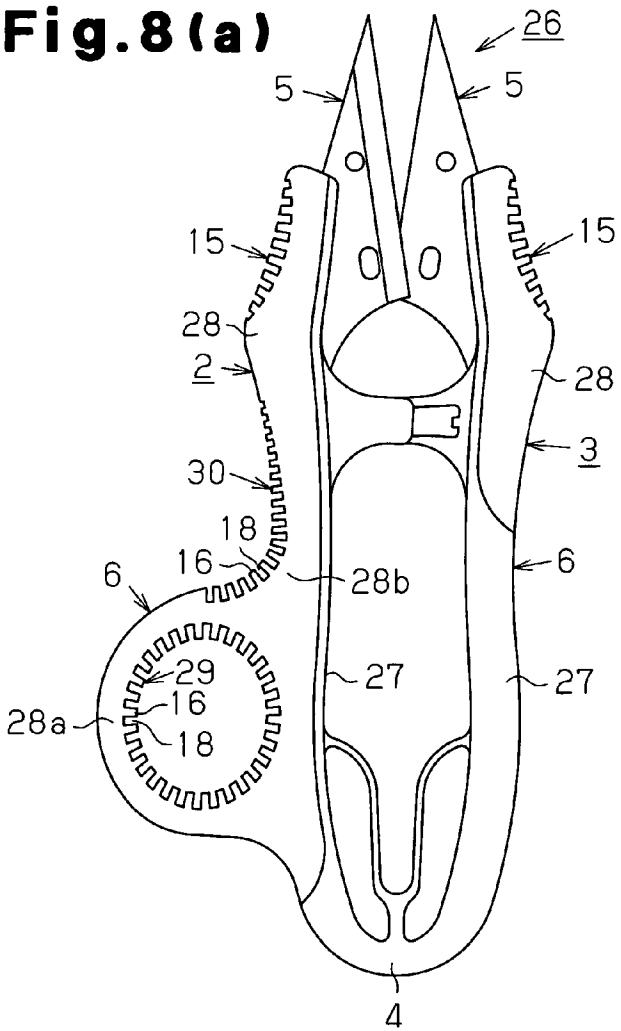
Figure 9B:
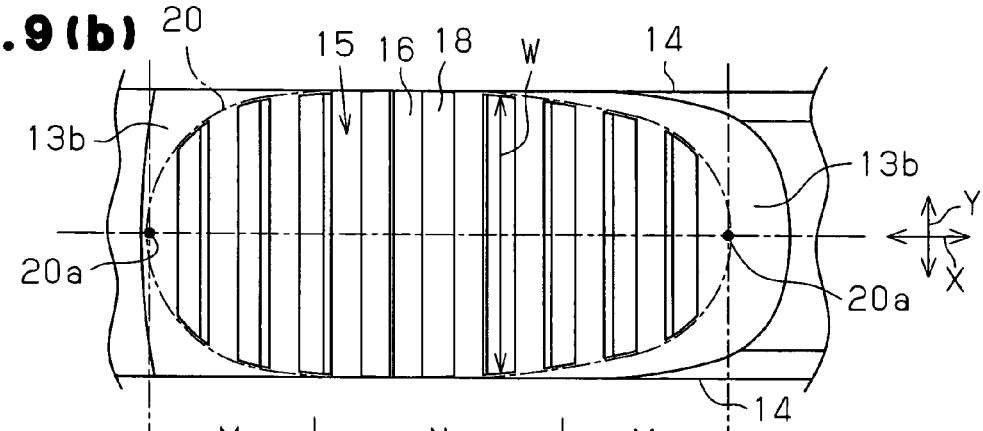
FIG. 9 (a) is an enlarged partial front view showing the finger receiving portion of FIG. 1(*c*); (b) is a view showing the finger receiving portion as viewed in the direction indicated by arrow 9*b*; (c) is an enlarged view showing a portion of FIG. 9(*a*); (d) and (e) are cross-sectional partial views showing a portion of FIG. 9(*a*) as viewed in the direction defined by the width.
Figure 9A:
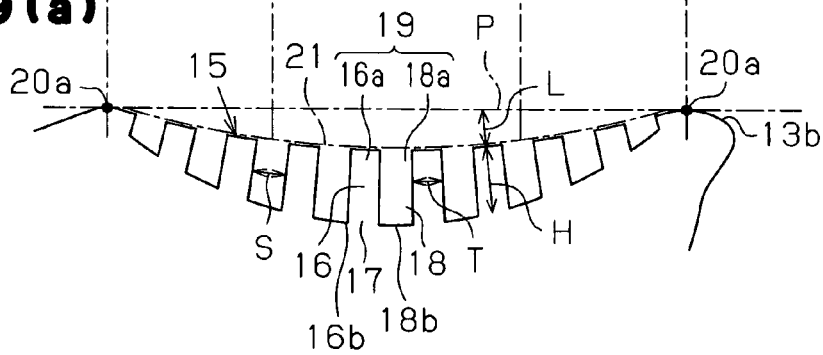
Figure 9C:
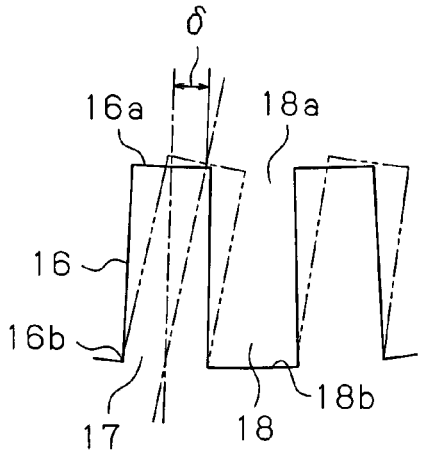
Figure 9D:
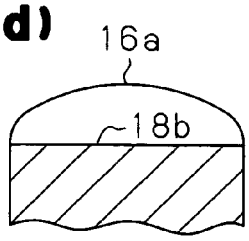
Figure 9E:
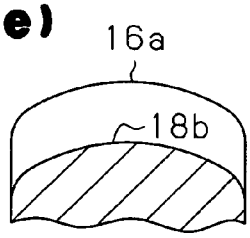
Figure 10A:
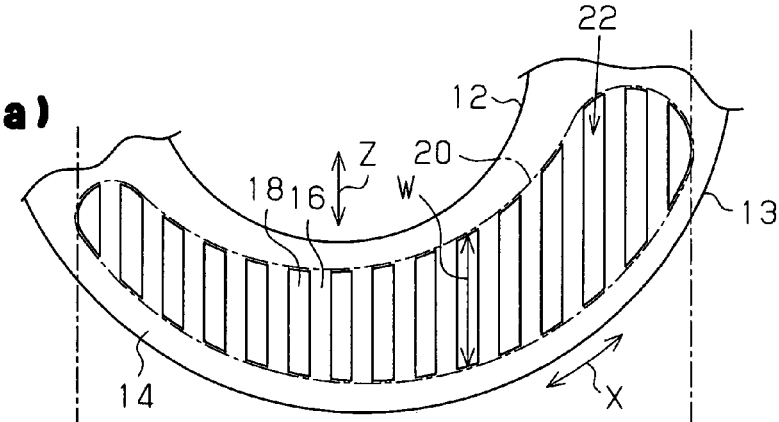
FIG. 10 (a) is an enlarged partial front view showing the finger receiving portion of FIG. 4(*c*); (b) is an enlarged partial bottom view showing the finger receiving portion of FIG. 4(*d*); (c) is an enlarged partial cross-sectional view of FIG. 10(*b*); (d) is an enlarged partial front view showing a modification of the third embodiment in correspondence with FIG. 10(*a*); (e) is a partial cross-sectional view as viewed in the direction defined by the thickness in FIG. 10(*d*)
Figure 10B:
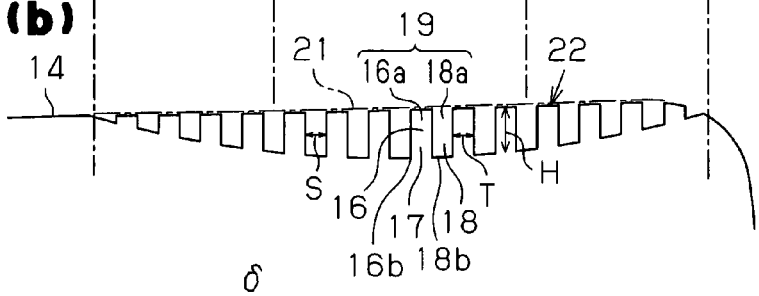
Figure 10C:
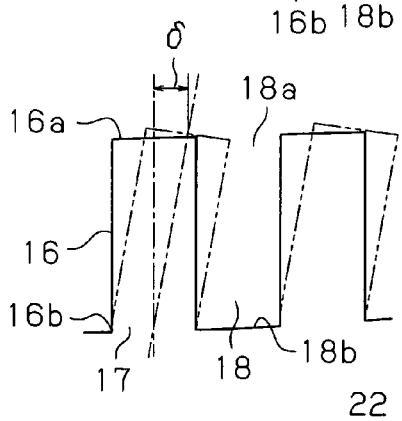
Figure 10D:
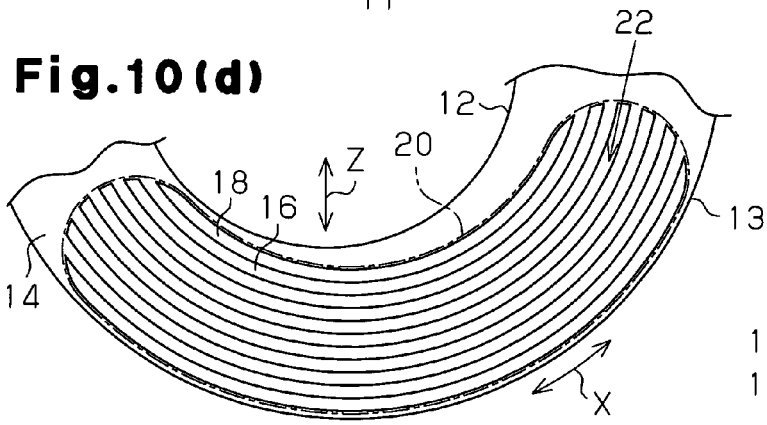
Figure 10E:
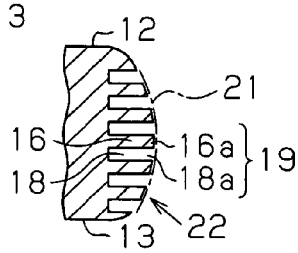

In a seventh embodiment, as illustrated in FIGS. 8(*a*) and 8(*b*), a soft portion 29 is formed along the entire inner circumference of an annular portion 28*a* of a fingerhook portion 28 of a scissor piece 2 of the sixth embodiment. A soft portion 30 is provided in a recessed portion 28*b* that extends distally from the annular portion 28*a*. In each of the soft portions 29, 30, elastic projections 16 and grooves 18 defined between each adjacent pair of the elastic projections 16 are arranged alternately.

Since, according to the third, fourth, fifth, and seventh embodiments, the soft portions 22, 23, 24, 25, 29, and 30 are provided in addition to the soft portions 15, the soft portions 22, 23, 24, 25, 29, 30 appropriately receive the balls, the backs, and the sides of fingers, thus enhancing the feel of the fingers.

Figure 11:
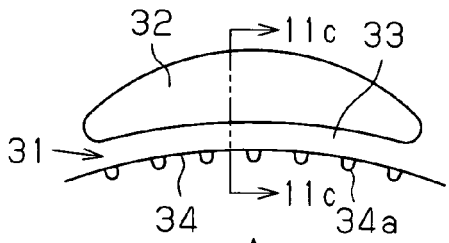
FIG. 11 (a) is an enlarged partial front view showing a finger receiving portion of handle portions of a pair of western scissors according to an eighth embodiment; (b) is a view showing the finger receiving portion as viewed in the direction indicated by arrow D; (c) is a cross-sectional view taken along line 11*c*-11*c* of FIG. 11(*a*)
Figure 11:
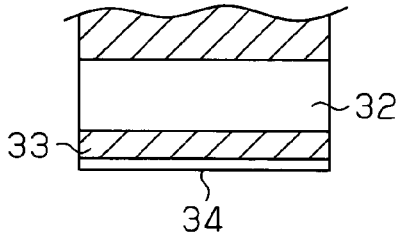
Figure 11:
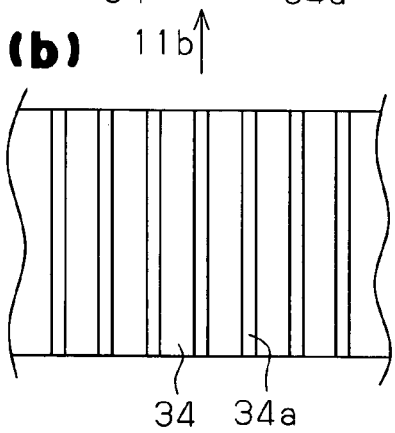

In an eighth embodiment, as illustrated in FIGS. 11(*a*) to 11(*c*), a soft portion 31 is provided instead of the soft portions 15 of the first to seventh embodiments. The soft portion 31 has a deformation allowing space 32, which is located inward from the outer circumferential surface of a fingerhook ring 10 and extends through the fingerhook ring 10. A finger receiving portion 33 (a leaf spring supported at both ends) is formed at a position facing the deformation allowing space 32. Anti-slip asperity portions 34*a* are arranged in parallel in a finger receiving surface 34 of the finger receiving portion 33.

Figure 12:
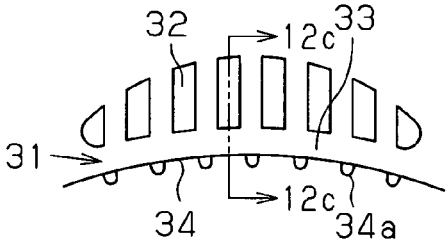
FIG. 12 (a) is an enlarged partial front view showing a finger receiving portion of opposing handle portions of a pair of western scissors according to a ninth embodiment; (b) is a view showing the finger receiving portion as viewed in the direction indicated by arrow 12*b*; and (c) is a cross-sectional view taken along line 12*c*-12*c* of FIG. 12(*a*).
Figure 12:
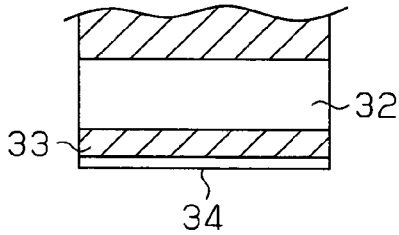
Figure 12:
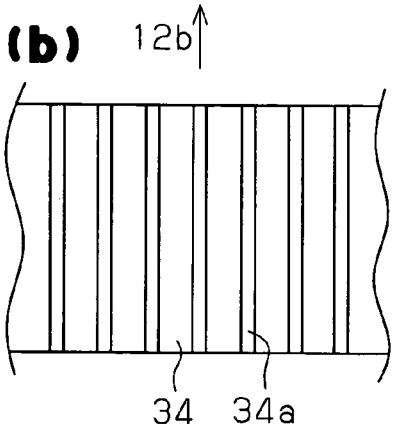

In a ninth embodiment, as illustrated in FIGS. 12(*a*) to 12(*c*), the deformation allowing space 32 of the eighth embodiment is divided into multiple portions.

Although not illustrated, the shapes or the locations of the soft portions of the western scissors 1 or the grip type scissors 26 may be modified as needed by combining any ones of the soft portions 15, 22, 23, 24, 25, 29, 30.

Although the support portion 9 of each holding portion 8 is formed of hard resin and each fingerhook ring 10 is formed of soft resin, the entire holding portion 8 may be formed as an integral body of hard or soft resin and the soft portions 15, 22, 23, 24, 25, 29, 30, 31 are formed in the holding portion 8.

The invention claimed is:

1. A pair of scissors comprising a fingerhook structure in which a pair of pieces of the scissors are supported by a pivotal center portion in such a manner as to allow the scissor pieces to open and close with respect to each other, the fingerhook structure comprising a fingerhook portion formed in at least one of handle portions, wherein each handle portion is provided in one of the scissor pieces, the fingerhook portion including a plurality of elastic projections that are arranged and extend from inward to outward defining a height of a corresponding elastic projection, a finger receiving portion being formed by outer ends of the elastic projections, each elastic projection being deformable by the force applied to the finger receiving portion, wherein the finger receiving portion has a finger receiving surface that is recessed inward with respect to an imaginary plane that connects opposite side portions of the finger receiving portions, and wherein the opposite side portions lie on an outer circumferential portion of the finger-receiving portion, the outer ends of the elastic projections are located on the recesses finger receiving surface, a deformation allowing space is provided in the fingerhook portion at a position between each adjacent pair of the elastic projections, openings of the deformation allowing spaces are exposed between adjacent pair of the outer ends of the elastic projections, and wherein the height of the elastic projections becomes gradually greater from the opposite side portions of the finger receiving portion toward an intermediate portion between the opposite side portions.

2. The scissors according to claim 1, wherein the deformation space of the fingerhook portion is a groove defined between each adjacent pair of the elastic projections.

3. The scissors according to claim 1, wherein if the finger receiving portion is divided into side areas including the outer circumferential portion of the finger receiving portion and an intermediate area between the side areas, deformation caused by the force in the finger receiving portion is greater in the intermediate area than the side areas due to the difference in height of the elastic projections.

4. The scissors according to claim 1, wherein blade portions are provided at distal portions of the scissor pieces, respectively, and the handle portions are arranged at proximal positions of the scissor pieces, respectively;

the fingerhook portion is one of a pair of fingerhook portions provided in the handle portions, respectively, and wherein each fingerhook portion is a fingerhook ring and has an inner circumferential surface, an outer circumferential surface, and opposing side surfaces between the inner circumferential surface and the outer circumferential surface; and the finger receiving portion is formed in at least one of the inner circumferential surface, the outer circumferential surface, and the side surfaces of at least one of the fingerhook rings.

5. The scissors according to claim 1, wherein the scissors are a pair of grip type scissors including a blade portion provided at a distal position of each of the scissor pieces.

* * * * *